US011724856B2

(12) United States Patent
Sekowski

(10) Patent No.: US 11,724,856 B2
(45) Date of Patent: Aug. 15, 2023

(54) HYBRID COLLAPSIBLE CONTAINER

(71) Applicant: Rehrig Pacific Company, Los Angeles, CA (US)

(72) Inventor: Daniel Vincent Sekowski, Loganville, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 17/240,177

(22) Filed: Apr. 26, 2021

(65) Prior Publication Data

US 2021/0331829 A1 Oct. 28, 2021

Related U.S. Application Data

(60) Provisional application No. 63/016,468, filed on Apr. 28, 2020.

(51) Int. Cl.

| | |
|---|---|
| ***B65D 21/032*** | (2006.01) |
| ***B65D 6/18*** | (2006.01) |
| ***B65D 25/30*** | (2006.01) |
| ***B65D 25/16*** | (2006.01) |

(52) U.S. Cl.
CPC ..... *B65D 11/1833* (2013.01); *B65D 25/16* (2013.01); *B65D 25/30* (2013.01)

(58) Field of Classification Search
CPC .... B65D 11/1833; B65D 25/16; B65D 25/30; B65D 15/22; B65D 21/0233; B65D 77/04; B65D 77/0413; B65D 77/042; B65D 77/0446; B65D 77/0453; B65D 15/24; B65D 5/56
See application file for complete search history.

(56) References Cited

U.S. PATENT DOCUMENTS

| | | | | |
|---|---|---|---|---|
| 909,615 | A * | 1/1909 | La Bauve | |
| 2,478,458 | A | 8/1949 | Carter, Sr. et al. | |
| 2,660,300 | A * | 11/1953 | Pauls | B65D 77/0446 229/123.2 |
| 3,155,304 | A | 11/1964 | Beerend | |
| 3,387,740 | A | 6/1968 | Bockenstette | |
| 4,139,115 | A | 2/1979 | Robinson | |
| 4,257,530 | A | 3/1981 | Faller | |
| 4,334,616 | A | 6/1982 | Wilson | |
| 4,588,096 | A | 5/1986 | Story et al. | |
| 4,801,017 | A | 1/1989 | Artusi | |
| 6,546,850 | B1 | 4/2003 | Akiyama-Warren | |
| 6,684,760 | B1 | 2/2004 | Rajusth | |
| 6,964,421 | B2 | 11/2005 | Friel | |

(Continued)

FOREIGN PATENT DOCUMENTS

| | | |
|---|---|---|
| EP | 0285457 A1 | 10/1988 |
| EP | 0456070 A1 | 11/1991 |

(Continued)

*Primary Examiner* — Stephen J Castellano
(74) *Attorney, Agent, or Firm* — Carlson, Gaskey & Olds, P.C.

(57) ABSTRACT

A collapsible container includes a frame including a base and a plurality of walls hingeably connected to edges of the base. At least one wall of the plurality of walls has a large opening therethrough. The large opening occupies a majority of the area of the at least one wall. An insert is received in the frame. The insert at least substantially covers the large opening in the at least one wall.

20 Claims, 22 Drawing Sheets

(56) References Cited

U.S. PATENT DOCUMENTS

| | | | | |
|---|---|---|---|---|
| 7,163,120 | B1 | 1/2007 | Blucher | |
| 7,320,405 | B2 | 1/2008 | Stahl | |
| 8,733,572 | B2 | 5/2014 | Ruiz Carmona | |
| 9,192,253 | B2 | 11/2015 | Ringler | |
| 9,744,738 | B2 * | 8/2017 | Pugh | B30B 11/18 |
| 2003/0080124 | A1 * | 5/2003 | Parker | A45C 13/1076 220/4.21 |
| 2004/0251255 | A1 | 12/2004 | Azzar | |
| 2005/0183980 | A1 | 8/2005 | Fernandez et al. | |
| 2008/0173219 | A1 | 7/2008 | Yankello et al. | |
| 2011/0127735 | A1 | 6/2011 | Bernard et al. | |
| 2011/0220520 | A1 | 9/2011 | Moss | |
| 2012/0061386 | A1 | 3/2012 | Parsons | |
| 2012/0103851 | A1 | 5/2012 | Ruiz Carmona | |
| 2012/0153013 | A1 | 6/2012 | Covelli | |
| 2013/0146602 | A1 | 6/2013 | Lessard et al. | |
| 2014/0231299 | A1 | 8/2014 | Hassell et al. | |

FOREIGN PATENT DOCUMENTS

| | | | |
|---|---|---|---|
| GB | 2177685 | A | 1/1987 |
| WO | 2009087695 | A1 | 7/2009 |

* cited by examiner

HYBRID COLLAPSIBLE CONTAINER

BACKGROUND

Produce, such as bananas, are often shipped to stores in cardboard boxes. The cardboard boxes may become damaged during shipping, which may also permit damage to the produce. Further, the cardboard boxes cannot be reused and must be discarded or recycled after each use.

SUMMARY

A collapsible container includes a frame including a base and a plurality of walls hingeably connected to edges of the base. At least one wall of the plurality of walls has a large opening therethrough. The large opening occupies a majority of the area of the at least one wall. An insert is received in the frame. The insert at least substantially covers the large opening in the at least one wall.

The base and the plurality of walls of the frame may each be formed of molded plastic. The insert may be formed of a material different from the frame, such as cardboard or foam core board.

In one embodiment, each of the walls of the container has the large opening that is at least substantially covered by the insert (e.g. at least enough of the opening is covered to retain the product in the container, for example at least half of the opening is covered). In the example embodiment, the entire opening is covered by the insert except for the handle openings in the end walls.

DETAILED DESCRIPTION

Figure 1:
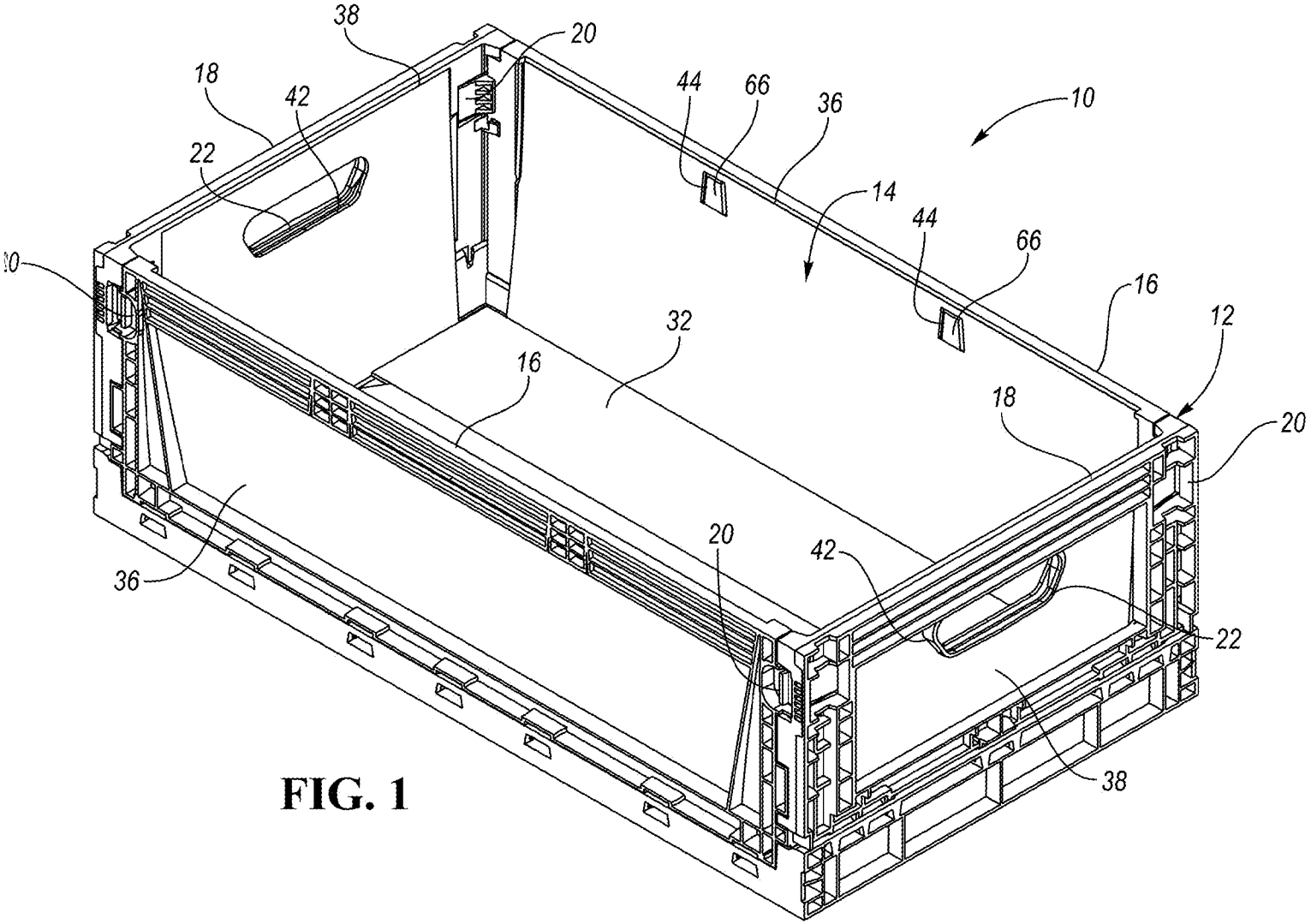
FIG. 1 is a perspective view of an example collapsible container.

FIG. 1 shows a hybrid collapsible container 10 including a frame 12 and an insert 14. The frame 12 includes a pair of opposed side walls 16 and a pair of opposed end walls 18. The side walls 16 and end walls 18 are selectively connected to one another at corners by latches 20. Each end wall 18 includes a handle loop 22 defining a handle opening therethrough.

The insert 14 is received inside the frame 12 and includes a base 32, side panels 36 extending upward from side edges of the base 32 and end panels 38 extending upward from end edges of the base 32. The side panels 36 abut inner surfaces of the side walls 16. The end panels 38 abut inner surfaces of the end walls 18. Handle openings 42 in each of the end panels 38 receive the handle loops 22 of each end wall 18 of the frame 12.

Figure 2:
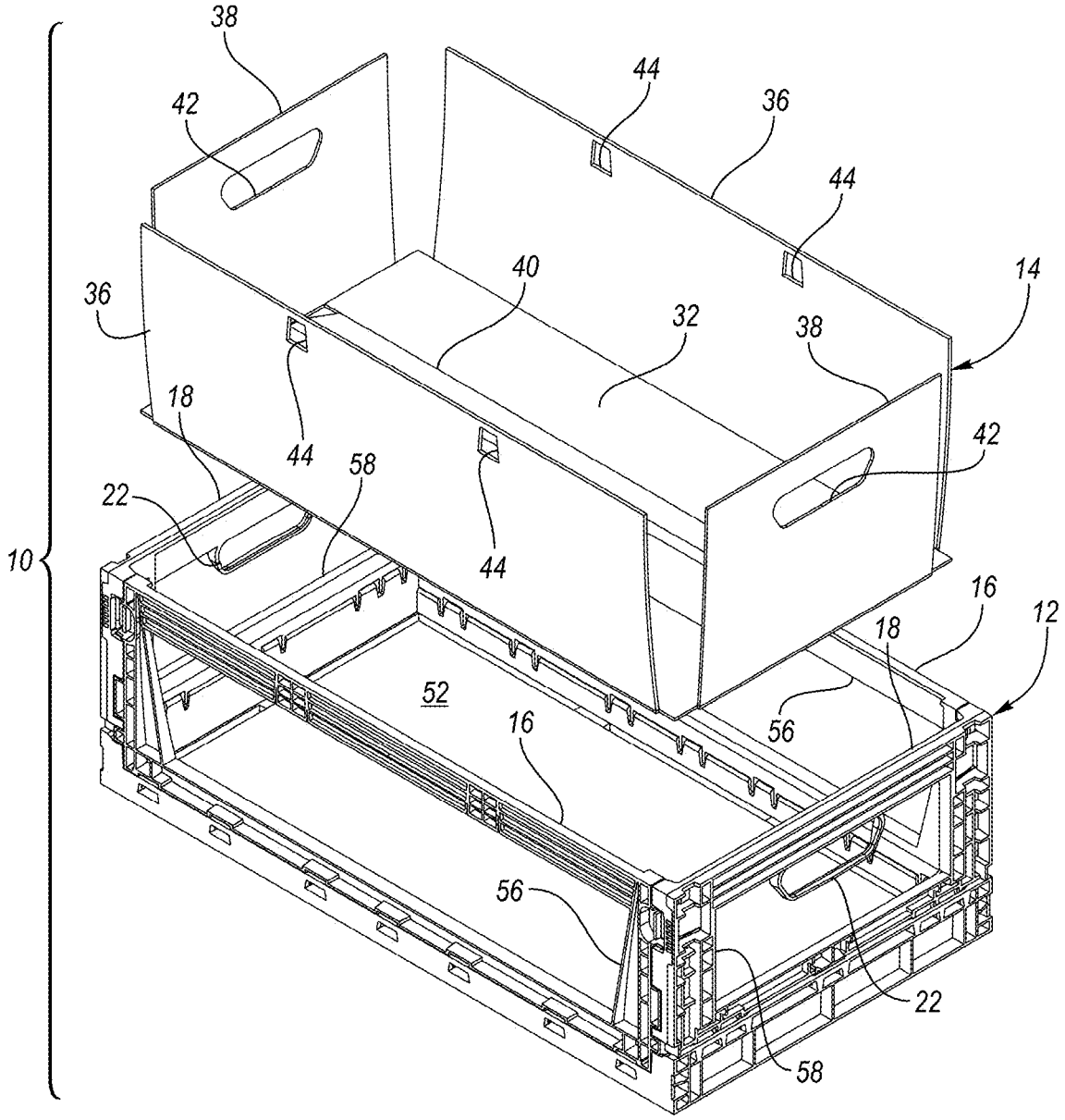
FIG. 2 is an exploded view of the container of FIG. 1.

FIG. 2 is an exploded view of the container 10 of FIG. 1. The base 32 of the insert 14 includes a center raised portion 40 which is created by a series of folds in the base 32. A plurality of apertures 44 are formed adjacent upper edges of the side panels 36.

The frame 12 includes a base 52. The side walls 16 and end walls 18 are hingeably connected to the base 52. In the embodiment shown, the side walls 16, end walls 18, and base 52 are each separately injection molded of a suitable plastic. Each of the side walls 16 is substantially open, defining a large side opening 56 through just a frame. Similarly, each of the end walls 18 is substantially open, defining a large end opening 58 through just a frame. In the end walls 18, the handle loops 22 project into the end openings 58.

Figure 3:
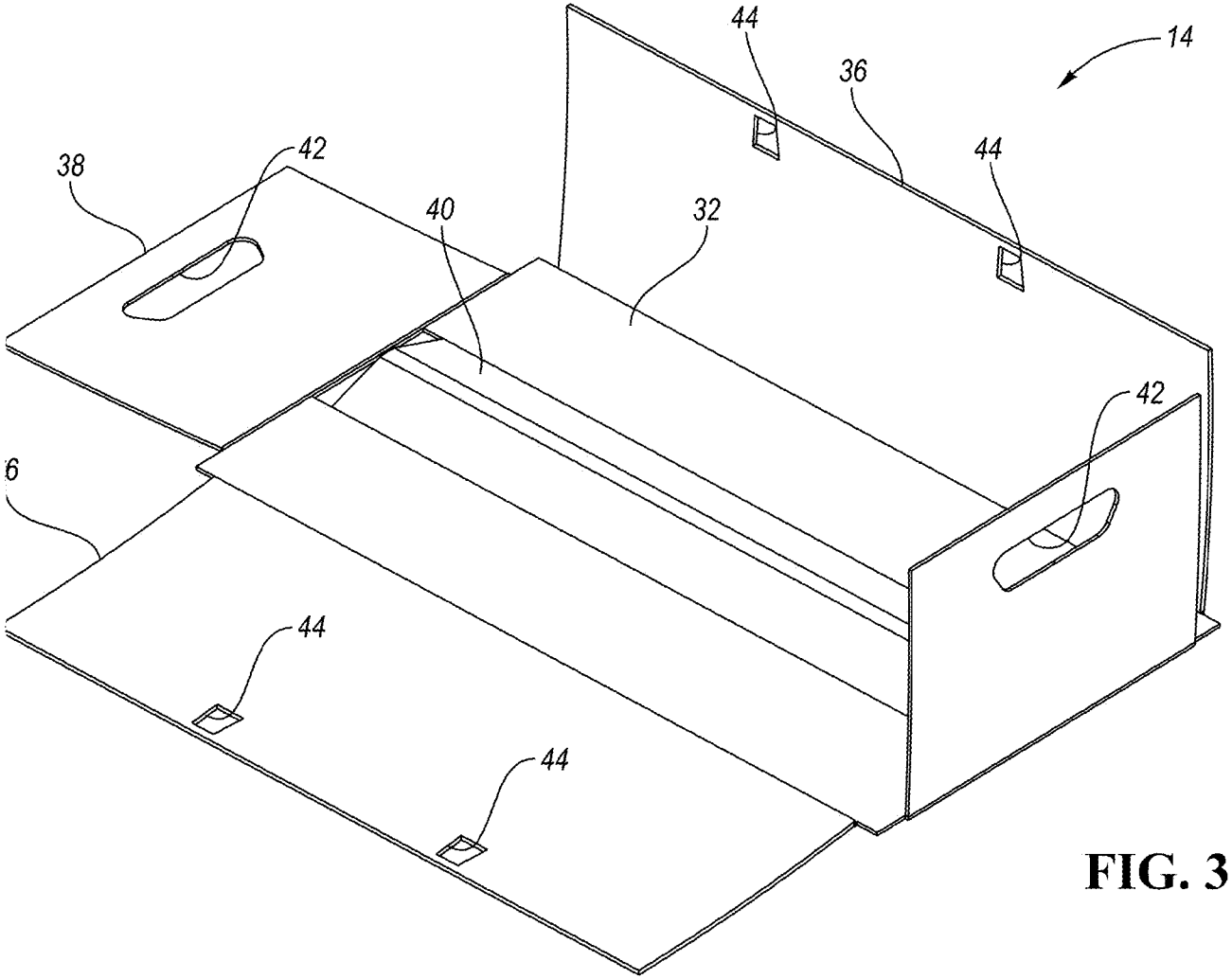
FIG. 3 is a perspective view of the insert of FIG. 1.

FIG. 3 shows the insert 14. The insert 14 may be formed from a material different from the frame 12, such a single sheet of a paper product such as corrugated cardboard, or foamboard, or the like. The end panels 38 and side panels 36 are hingeably connected to the base 32.

Figure 4:
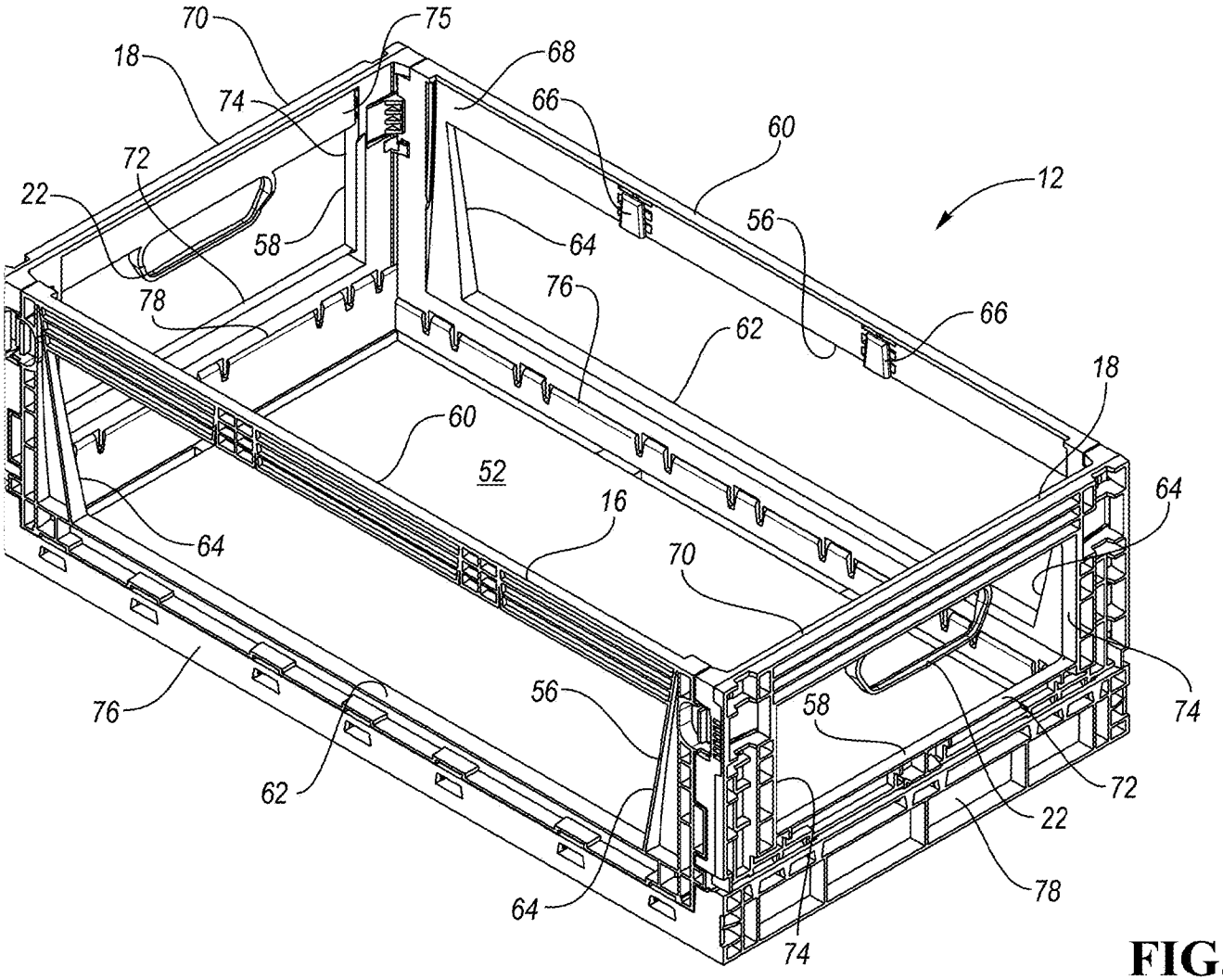
FIG. 4 is a perspective view of the frame of FIG. 1.

FIG. 4 shows the frame 12. The side walls 16 each include an upper rail 60, a lower rail 62, and opposed end rails 64 connecting the upper rail 60 to the lower rail 62. The rails 60, 62, 64 circumscribe the side opening 56. The side opening 56 preferably comprises a majority of the area of the side wall 16, and more preferably comprises more than ⅔ of the area, and even more preferably comprises more than 80% of the area of the side wall 16.

An inner surface of the upper rail 60 includes a plurality of connectors 66 projecting inward therefrom. The connectors 66 are complementary to the apertures 44 formed in the side panels 36 of the insert 14 (FIG. 2). FIG. 1 shows the connectors 66 received in the apertures 44 in a friction or interference fit.

The inner surface of each side wall 16 includes a large tapered recess 68 for receiving the side panel 36 (FIG. 2). The recess 68 is tapered outward so that the side panels 36 of the insert (FIG. 2) will be angled slightly outward. The recess 68 also helps retain the side panels 36 with a friction or interference fit.

The end walls 18 each include an upper rail 70, a lower rail 72, and opposed end rails 74 connecting the upper rail 70 to the lower rail 72. The rails 70, 72, 74 circumscribe the end opening 58. The end opening 58 preferably comprises a majority of the area of the end wall 18, and more preferably comprises more than ⅔ of the area, and even more preferably comprises more than 75% of the area of the end wall 18.

The inner surface of each end wall 18 includes a large tapered recess 75 for receiving the end panel 38 (FIG. 2). The recess 75 is tapered outward so that the end panels 38 of the insert (FIG. 2) will be angled slightly outward. The recess 75 also helps retain the end panels 38 with a friction or interference fit.

The base 52 includes a lower panel portion forming a floor of the frame 12. The base 52 includes a pair of integrally-molded upstanding side flanges 76 and a pair of upstanding end flanges 78. The end flanges 78 are taller than the side flanges 76. The side walls 16 are hingeably connected to the side flanges 76 and the end walls 18 are hingeably connected to the end flanges 78.

Figure 5:
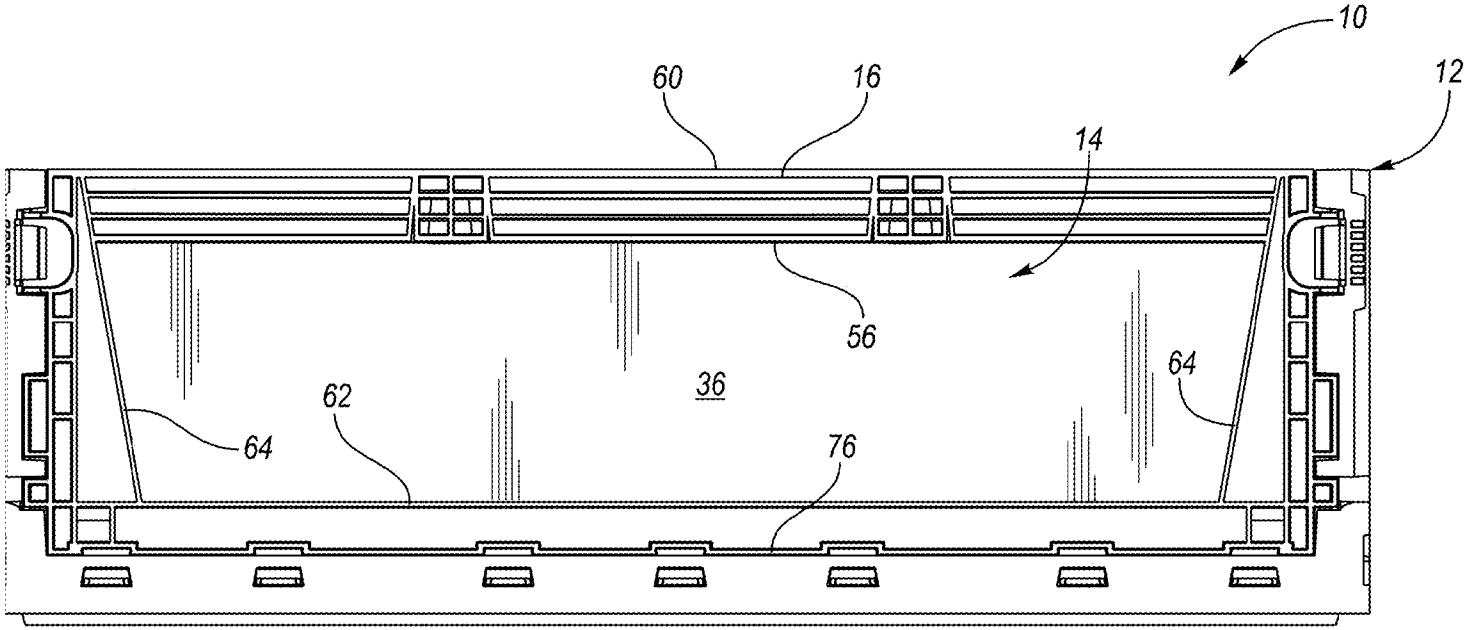
FIG. 5 is a side view of the container of FIG. 1.

FIG. 5 is a side view of the container 10 of FIG. 1. The side panel 36 of the insert 14 is visible through the large side opening 56 in the side wall 16.

Figure 6:
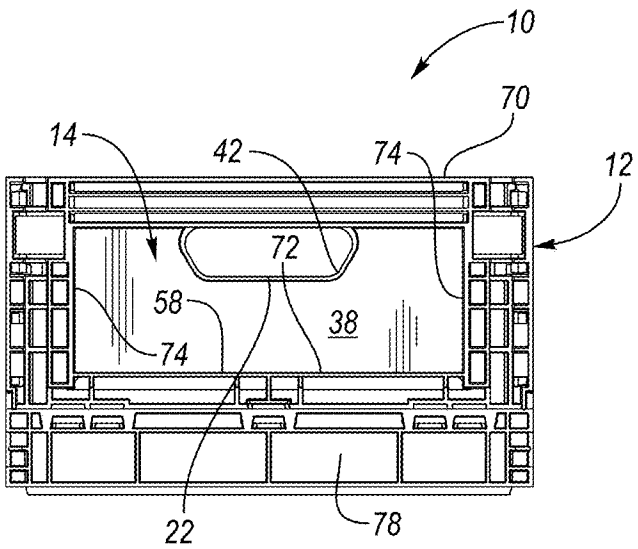
FIG. 6 is an end view of the container of FIG. 1.
Figure 8:
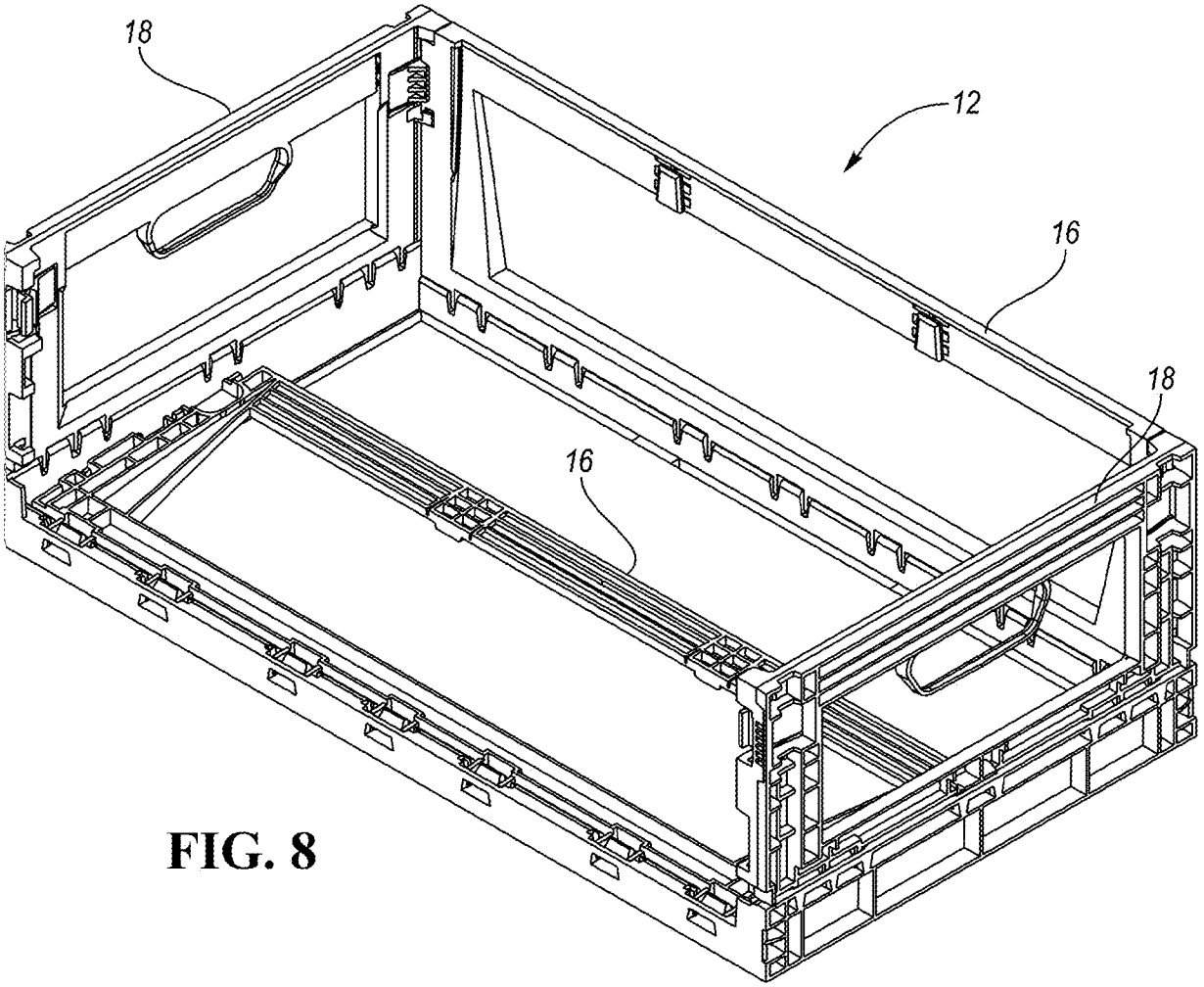
FIG. 8 shows a first step in collapsing the frame of FIG. 4.
Figure 9:
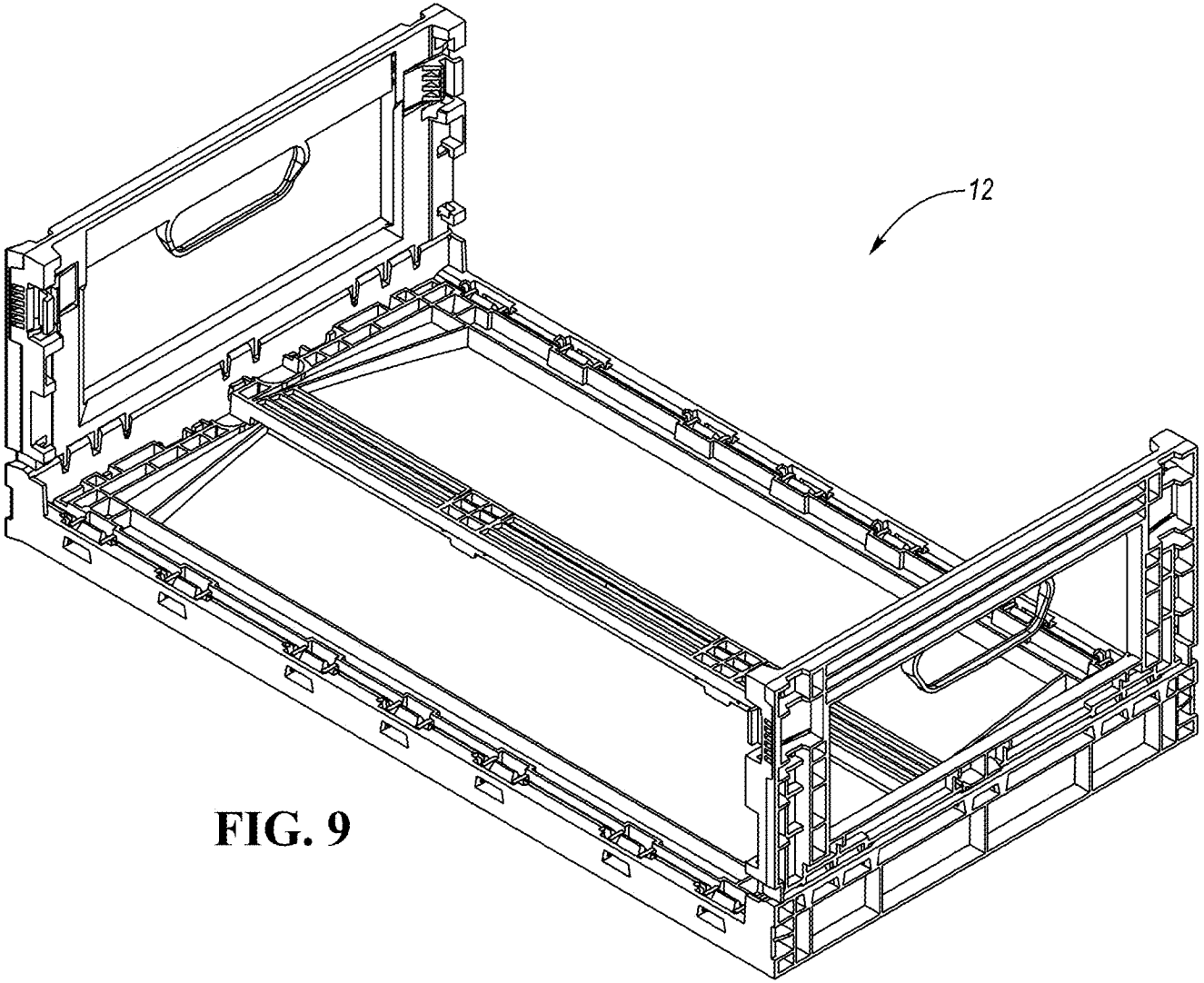
FIG. 9 shows a second step in collapsing the frame of FIG. 4.
Figure 10:
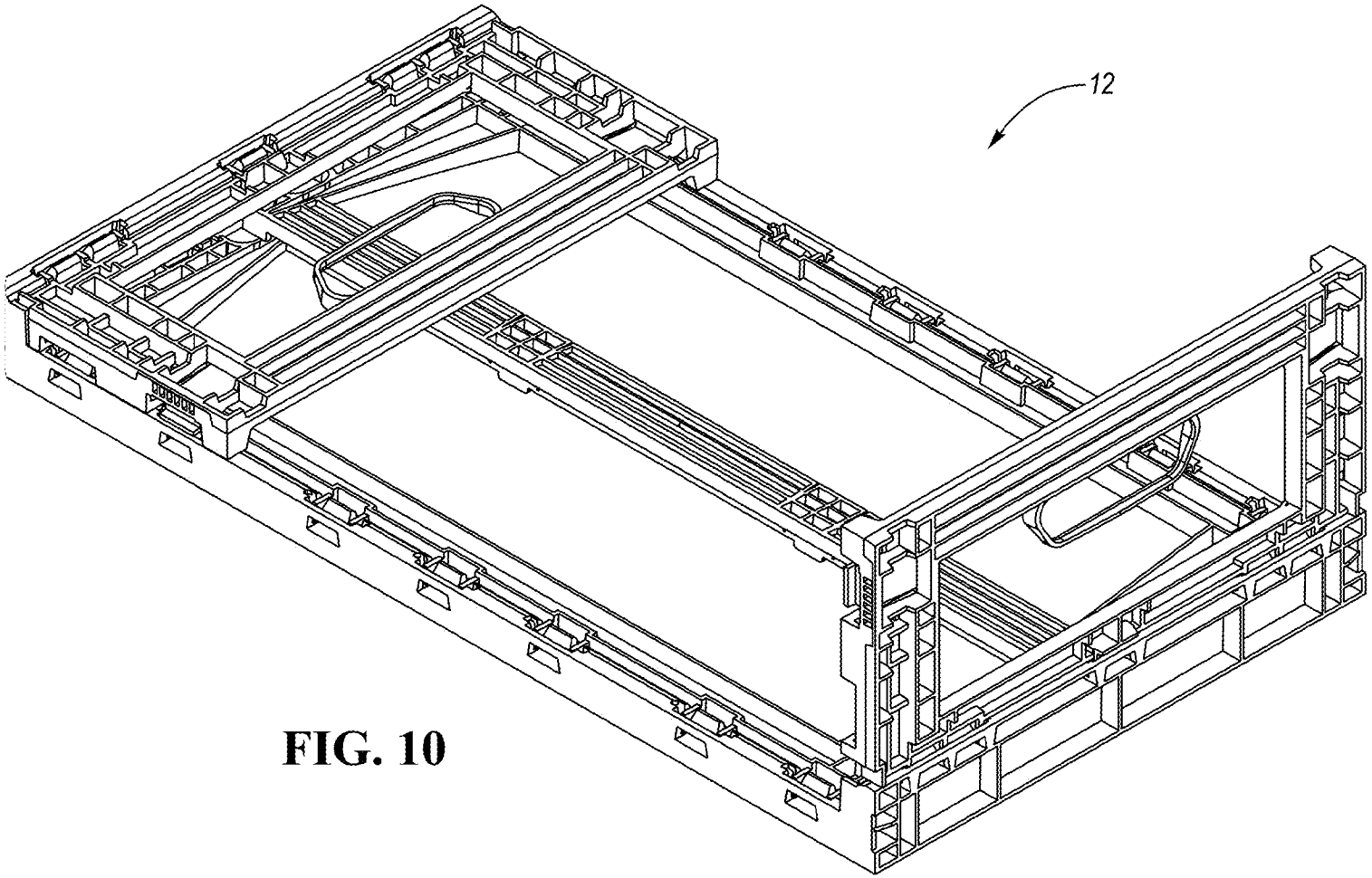
FIG. 10 shows a third step in collapsing the frame of FIG. 4.
Figure 11:
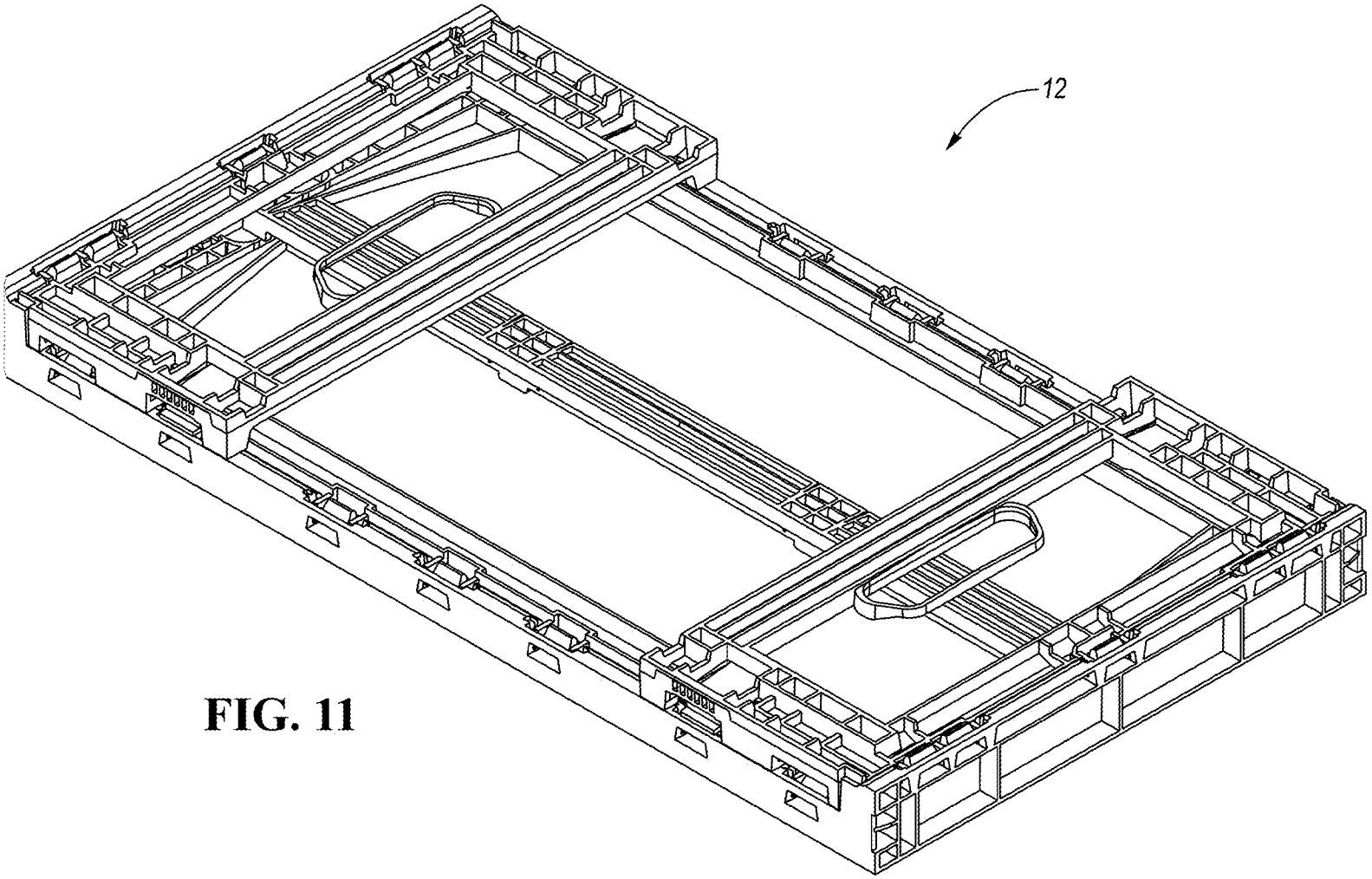
FIG. 11 shows a fourth step in collapsing the frame of FIG. 4.

FIG. 6 is an end view of the container 10. The end panel 38 of the insert 14 is visible through the large end opening 58. The handle loop 22 is received in the handle opening 42 of the insert 14.

Figure 7:
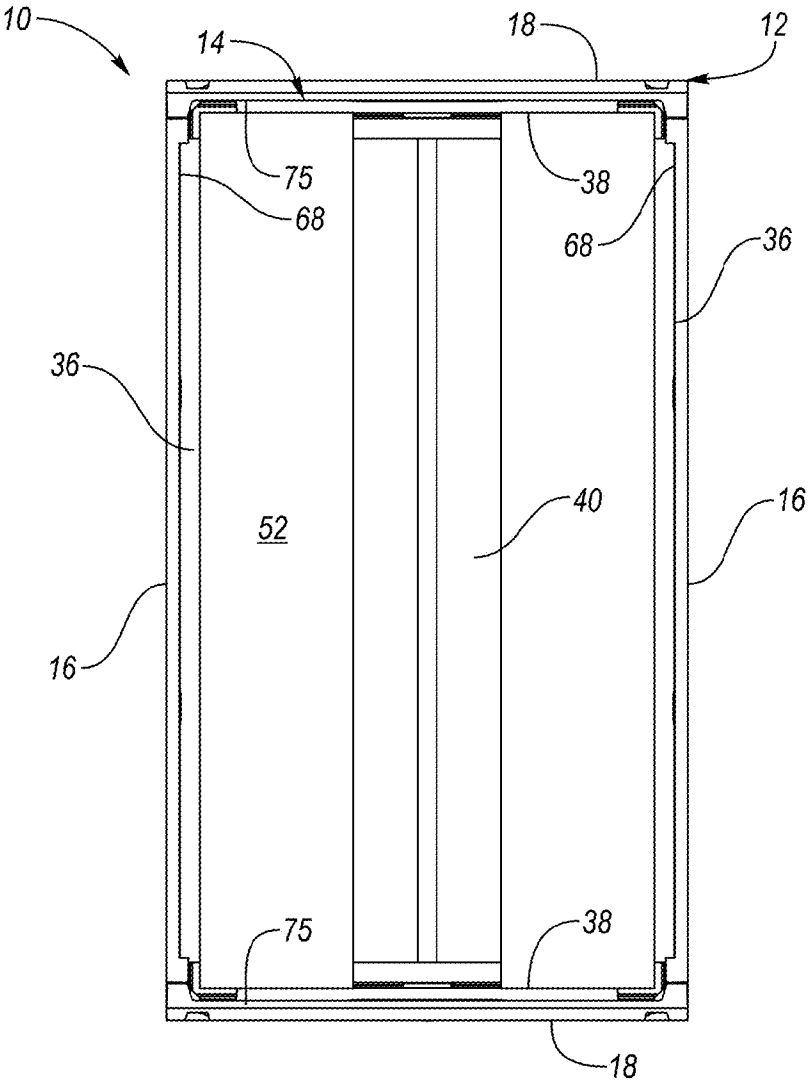
FIG. 7 is a top view of the container of FIG. 1.

FIG. 7 is a top view of the container 10. The side panels 36 of the insert 14 are received in the recesses 68 in the side walls 16. The end panels 38 of the insert 14 are received in the recesses 75 in the end walls 18. The center raised portion 40 of the insert 14 is created by folds in the base 52 of the insert 14. The center raised portion 40 is centered between the side walls 16 and extends from one end wall 18 to the other end wall 18.

Figure 12:
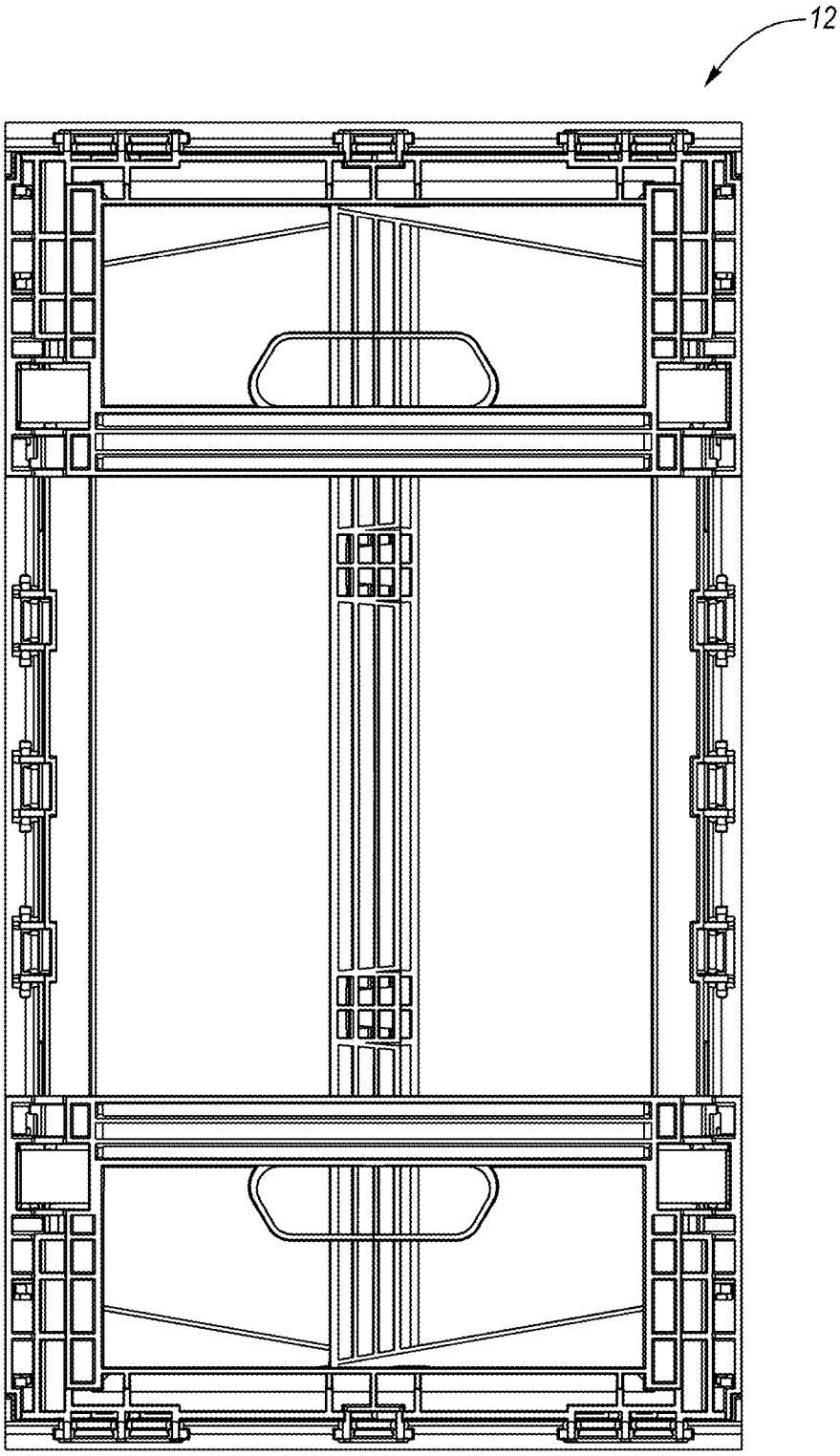
FIG. 12 is a top view of the collapsed frame.
Figure 13:
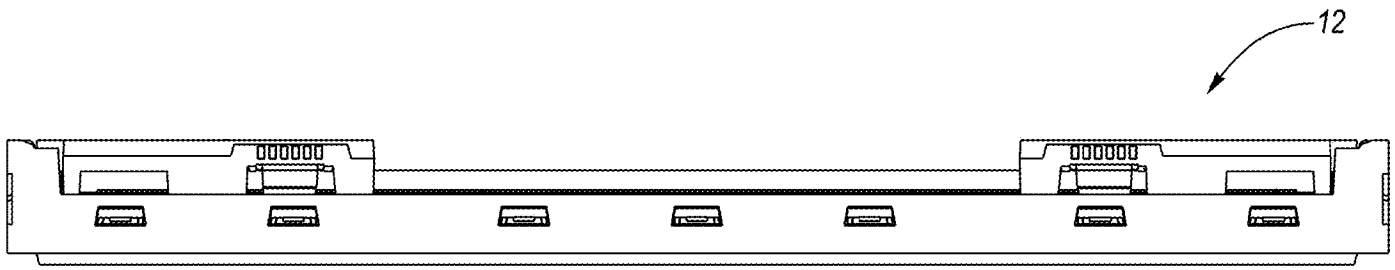
FIG. 13 is a side view of the collapsed frame.
Figure 14:
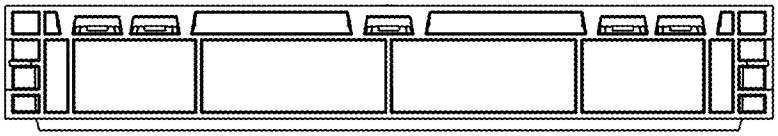
FIG. 14 is an end view of the collapsed frame.

FIGS. 8-11 show a sequence for collapsing the walls 16, 18 of the frame 12. FIG. 12 is a top view of the collapsed frame 12. FIG. 13 is a side view of the collapsed frame 12. FIG. 14 is an end view of the collapsed frame 12.

Figure 15:
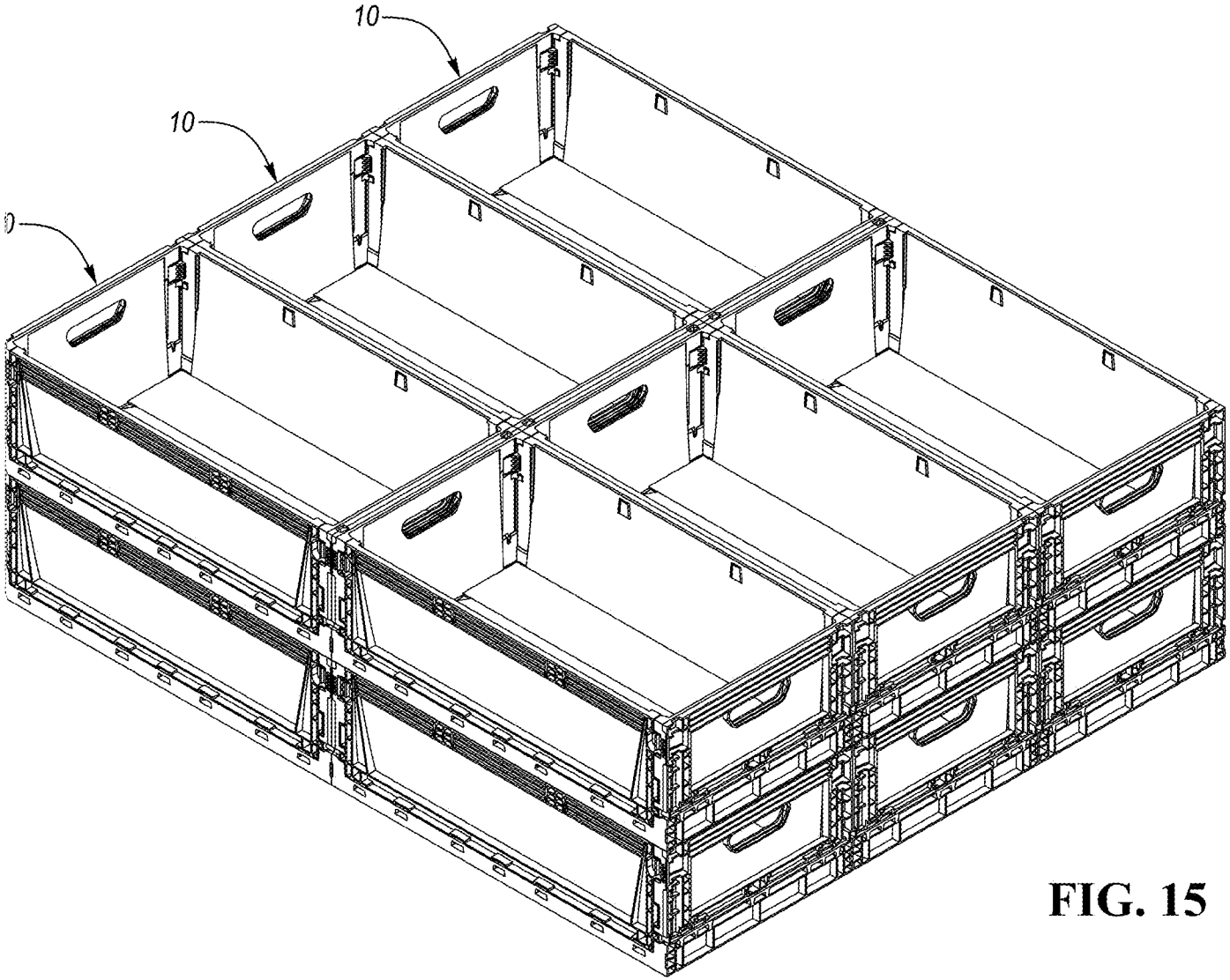
FIG. 15 shows a plurality of the containers of FIG. 1 stacked in two 3×2 layers.

FIG. 15 shows a plurality of the containers 10 of FIG. 1 stacked in two 3×2 layers. The containers 10 can be loaded with items, such as produce, such as bananas, and then stacked as shown on a pallet for shipping to a store or distribution facility.

Figure 16:
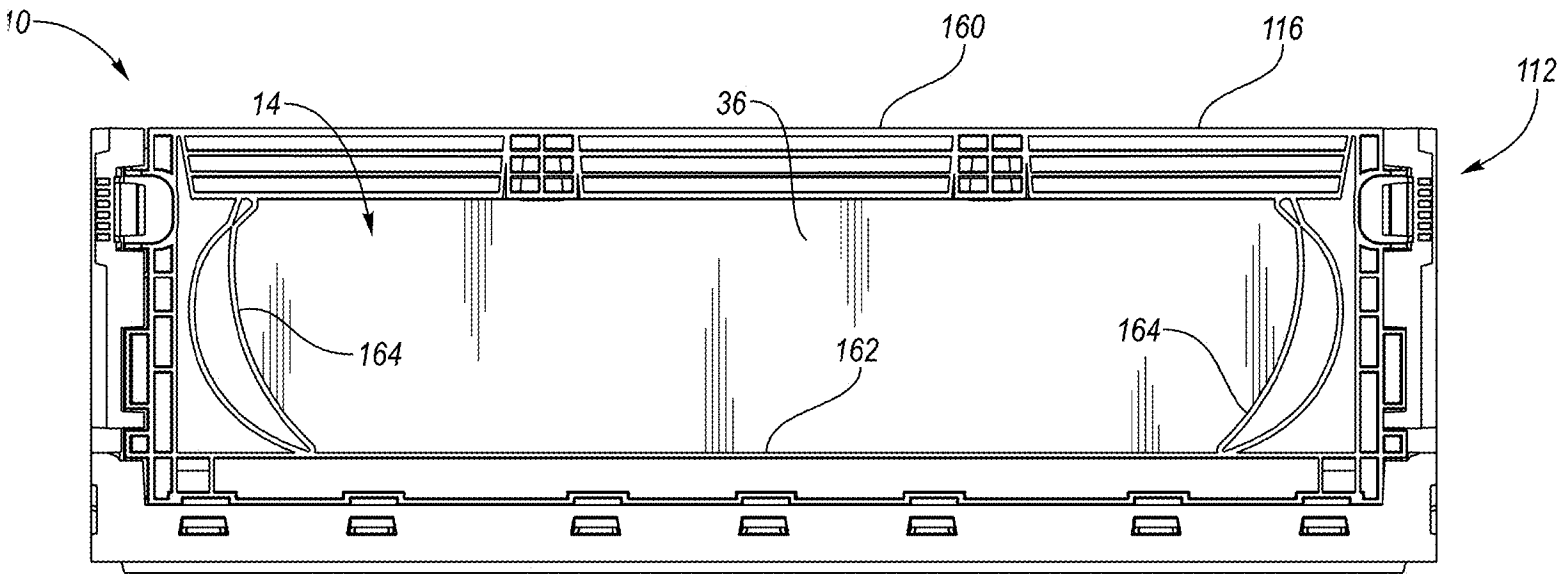
FIG. 16 is a side view of a container according to a second embodiment with an alternate side wall.

A collapsible container 110 according to a second embodiment, with an alternate frame 112 with an alternate side wall 116 is shown in FIG. 16. Other than the side wall 116, the rest of the container 110 is the same as the container 10 of FIG. 1. In this side wall 116, the end rails 164 have a more curved, concave inner surface, which may include banana logos or indicia. The end rails 164 help retain the side panels 36 of the insert 14.

Figure 17:
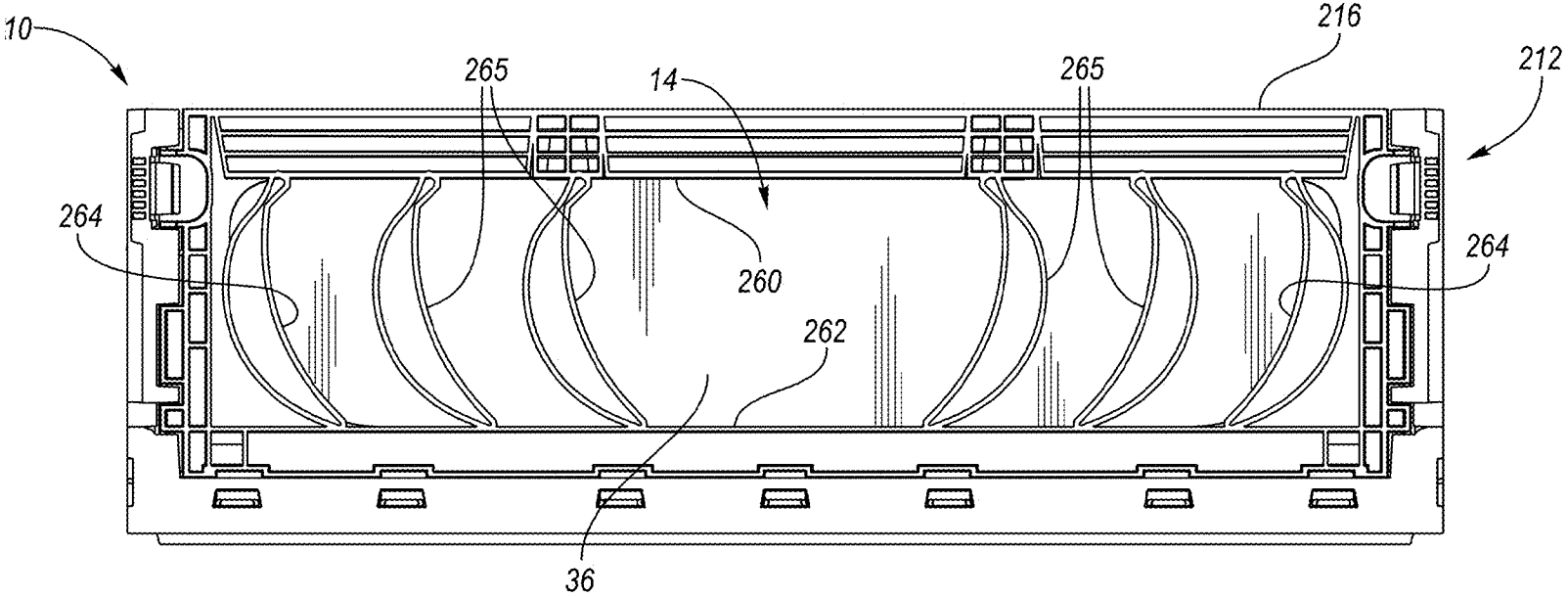
FIG. 17 is a side view of a container according to a third embodiment with an alternate side wall.

A collapsible container 210 according to a third embodiment, with an alternate frame 212 with an alternate side wall 216 is shown in FIG. 17. Other than the side wall 216, the rest of the container 210 is the same as the container 10 of FIG. 1. In this side wall 216, the end rails 264 have more prominent bananas molded therein. Additionally, spaced-apart columns 265 may extend from the upper rail 260 to the lower rail 262. The spaced-apart column 265 may also be in the shape of bananas, if the intended use of the container is for bananas. The spaced-apart column 265 help retain the side panels 36 of the insert 14.

Figure 18:
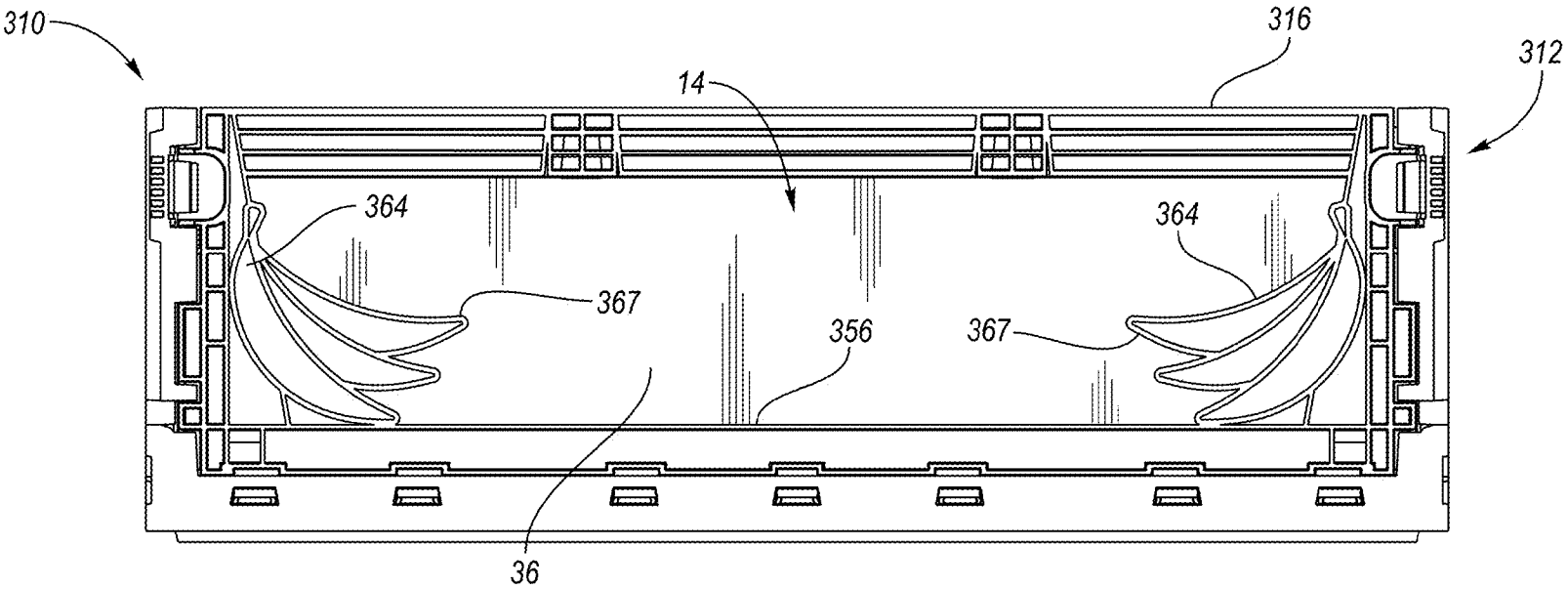
FIG. 18 is a side view of a container according to a fourth embodiment with an alternate side wall.

A collapsible container 310 according to a fourth embodiment, with an alternate frame 312 with an alternate side wall 316 is shown in FIG. 18. Other than the side wall 316, the rest of the container 310 is the same as the container 10 of FIG. 1. In this side wall 316, the end rails 364 are in the shape of a bunch of bananas 367, which project partway into the large opening 356. The end rails 364 help retain the side panels 36 of the insert 14.

Figure 19:
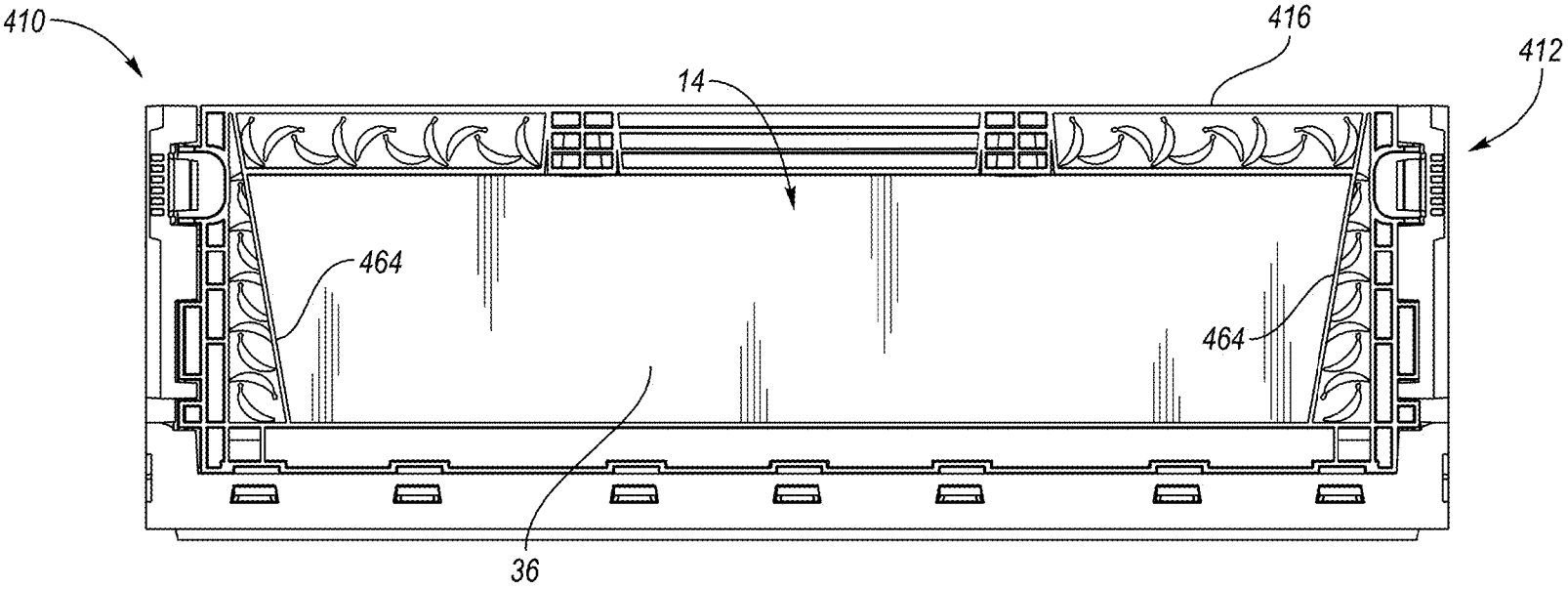
FIG. 19 is a side view of a container according to a fifth embodiment with an alternate side wall.

A collapsible container 410 according to a fifth embodiment, with an alternate frame 412 with an alternate side wall 416 is shown in FIG. 19. Other than the side wall 416, the rest of the container 410 is the same as the container 10 of FIG. 1. In this side wall 416, the end rails 464 are tapered but have a straight edge. Banana (or other) logos may be molded into the outer surface of the end rails 464. The end rails 164 help retain the side panels 36 of the insert 14.

Figure 20:
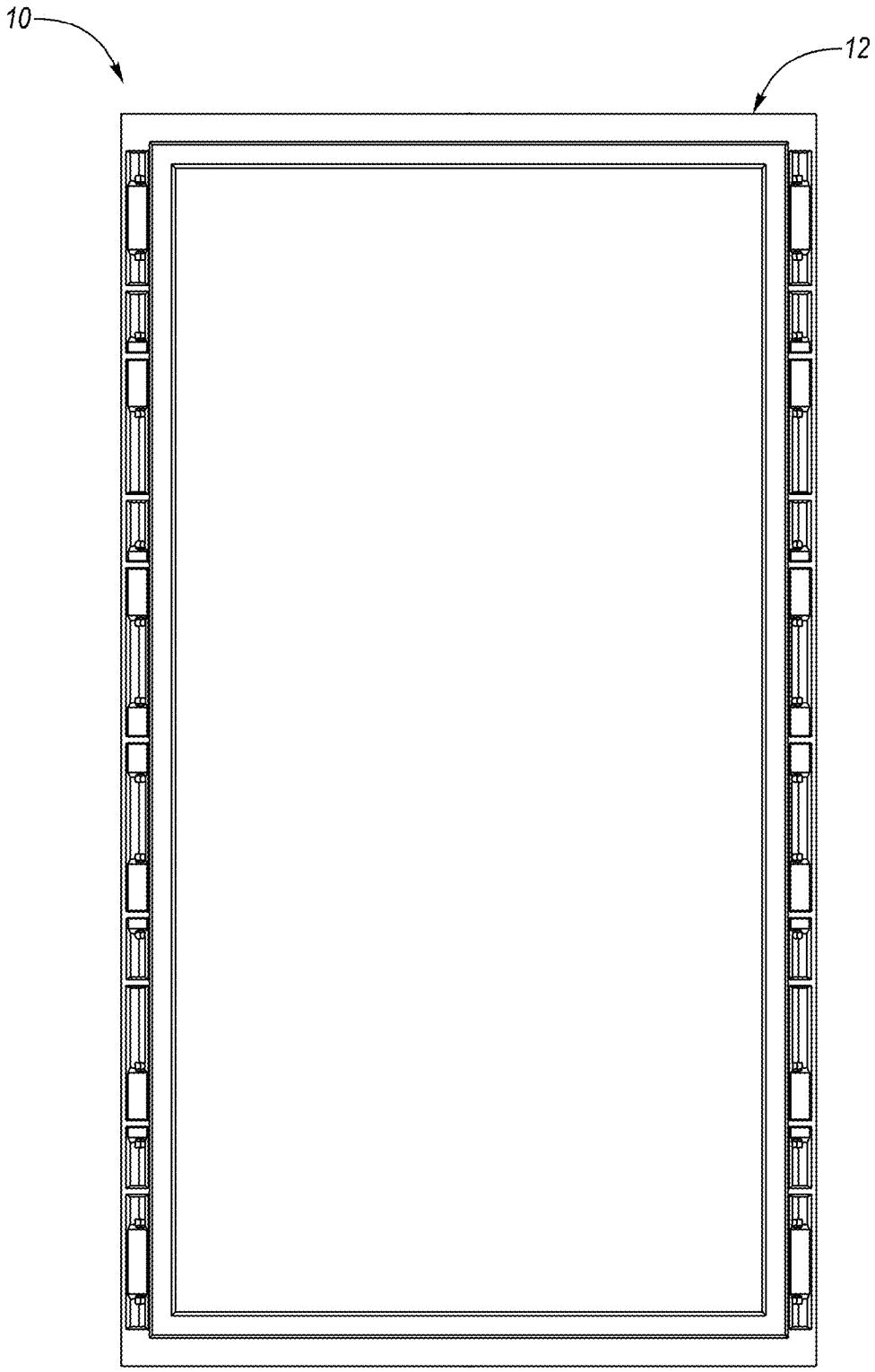
FIG. 20 is a bottom view of the container of FIG. 1.

FIG. 20 is a bottom view of the container 10 of FIG. 1.

Figure 21:
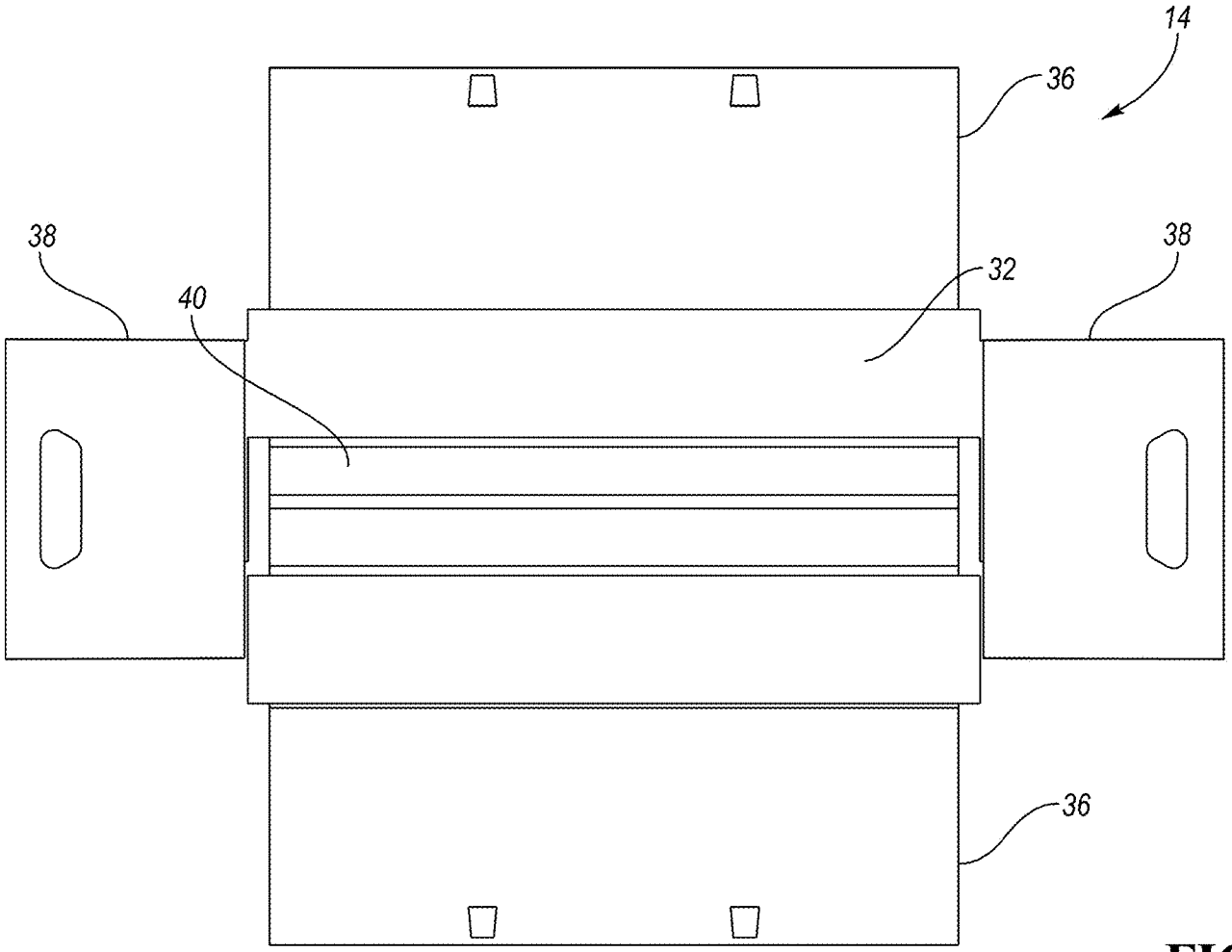
FIG. 21 is a plan view of the blank for forming the insert of FIG. 3.
Figure 22:
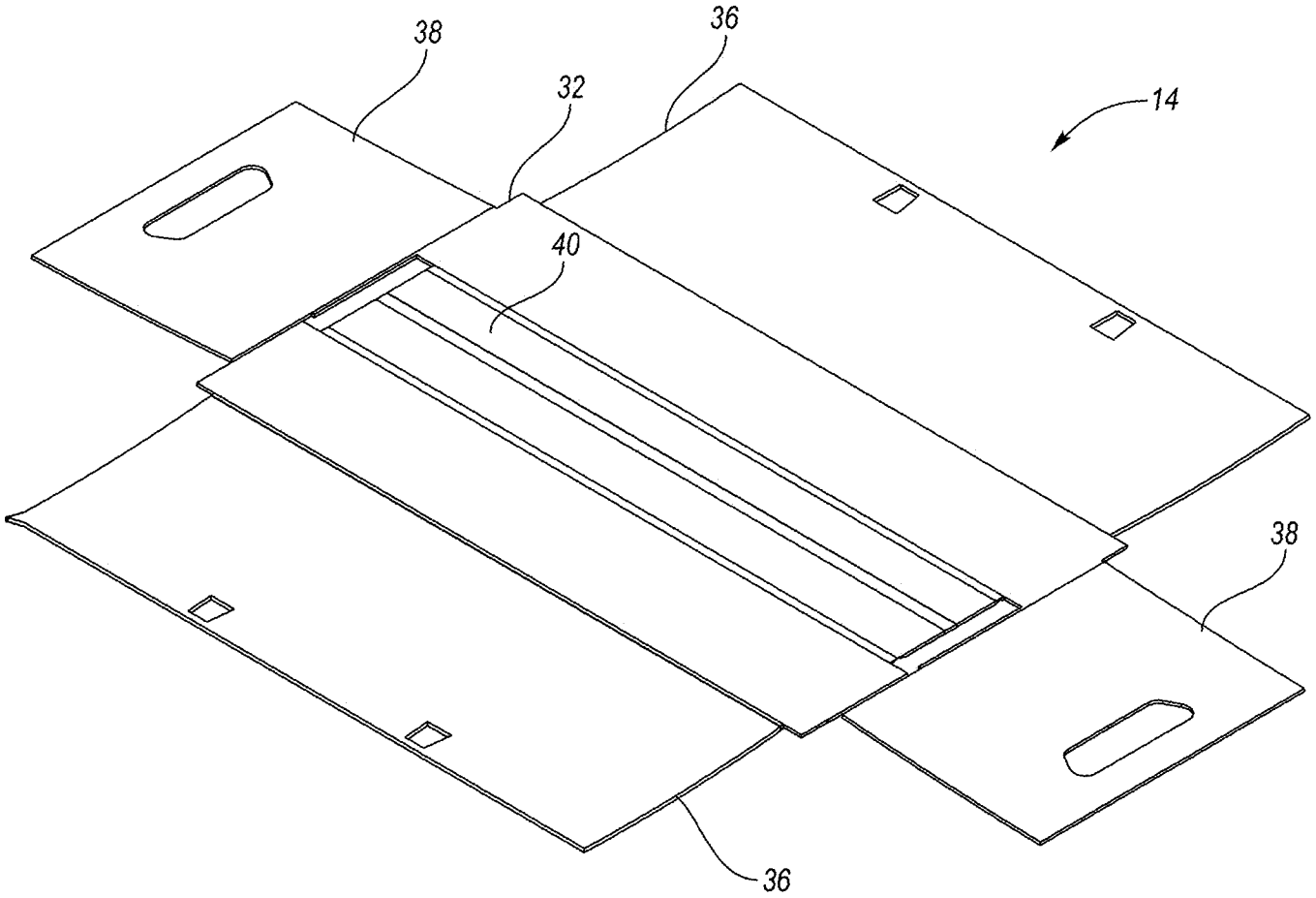
FIG. 22 is a perspective view of the blank of FIG. 21.

FIG. 21 is a plan view of the blank for forming the insert 14. The fold lines are shown between the base 32 and the end panels 38 and the side panels 36. Fold lines are shown in the base 32 for forming the center raised portion 40. FIG. 22 is a perspective view of the blank of FIG. 21.

Figure 23:
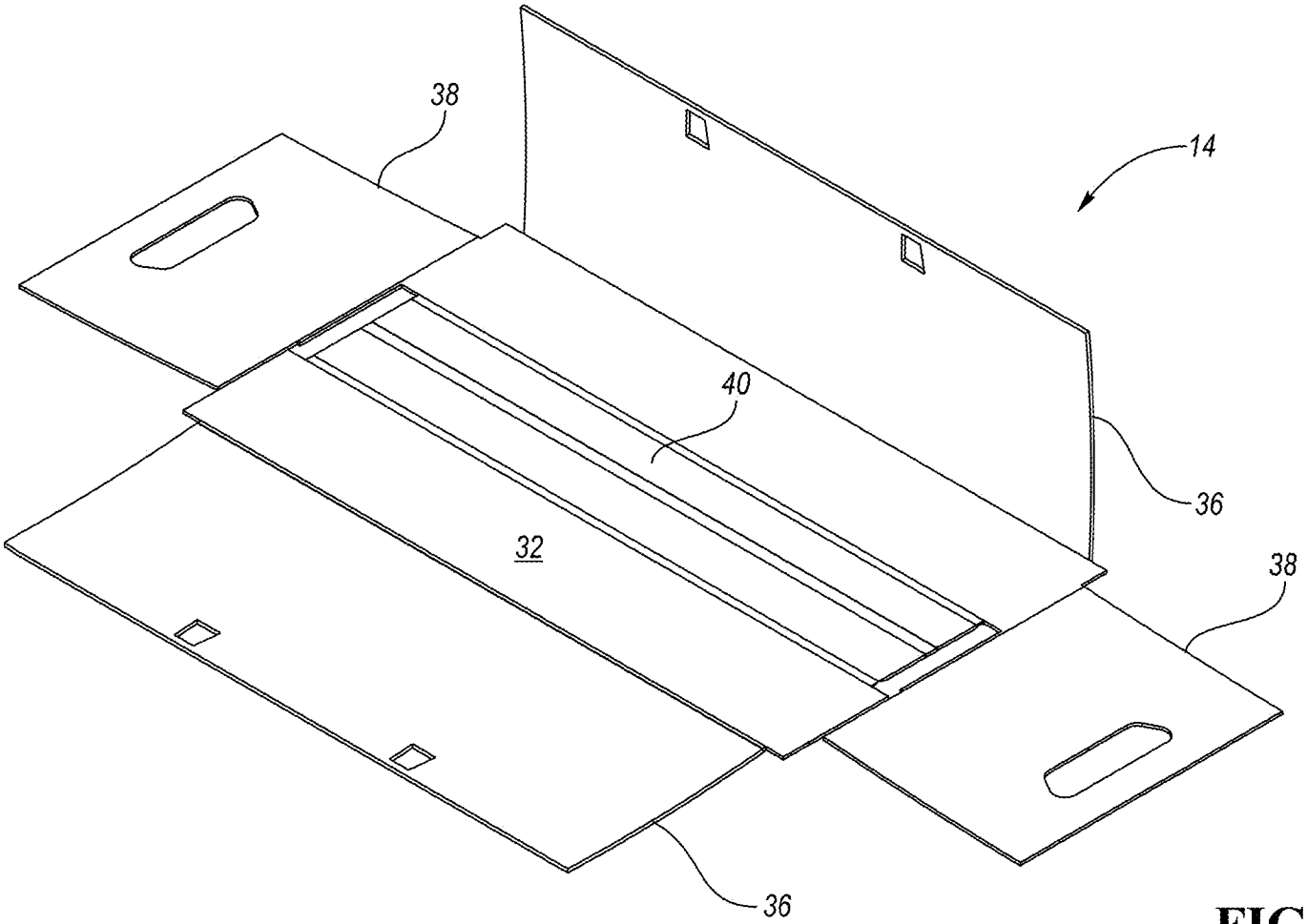
FIG. 23 shows a first step in folding the blank of FIG. 21.
Figure 25:
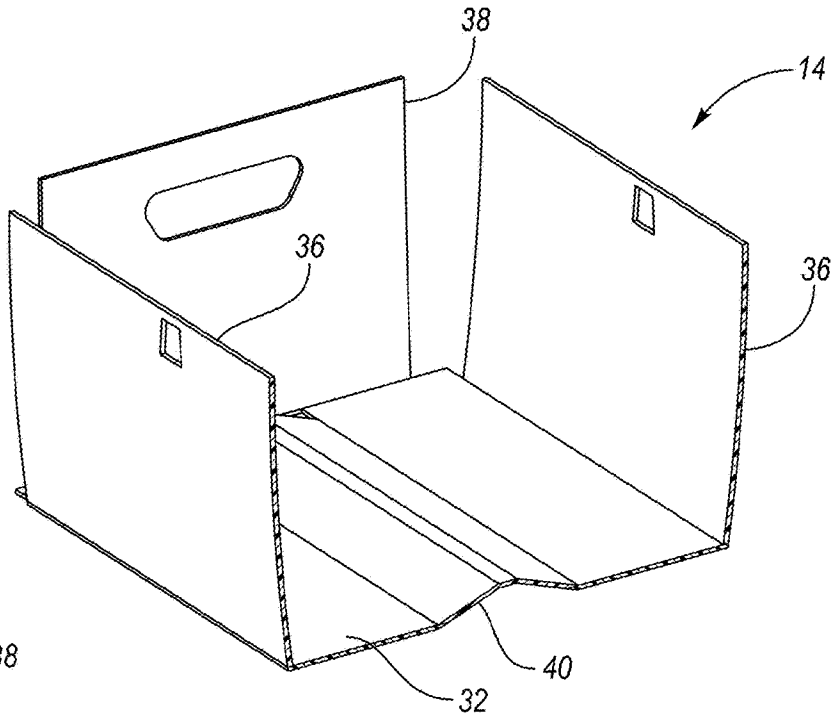
FIG. 25 shows the blank of FIG. 24, partially broken away.
Figure 24:
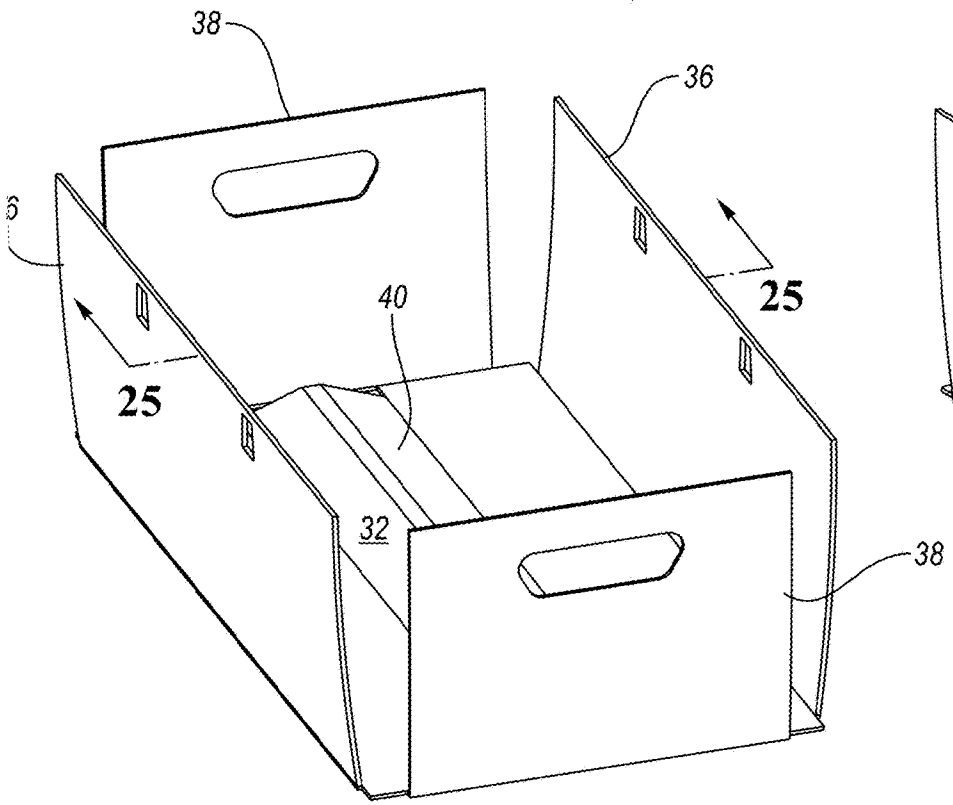
FIG. 24 shows a second step in folding the blank of FIG. 21.

FIG. 23 shows the blank for forming the insert 14 with one of the side panels 36 raised to the upright position. In FIG. 24, the other side panel 36 is raised to its upright position, as are end panels 38. The base 32 is folded along fold lines to form the center raised portion 40 as the first side panel 36 is moved closer to the second side panel 36. When the insert 14 is placed in the frame 12 (FIG. 2), the insert 14 is retained in the shape shown in FIG. 24. FIG. 25 shows the insert 14 partially broken away to show the center raised portion 40 in the base 32.

In use, the corrugate insert 14 provides a soft flexible barrier to protect the produce during shipping. It will provide the same benefits that a full corrugate container would provide but in a minimalistic manner. It could be sourced in the same area that the produce is harvested. It can be customized to the label/marking requirements of the producer. The insert can also be cut to provide access to the interior of the container 10, such as for inspection, even when other containers 10 are stacked on the container 10.

The frame 12 is generally a lightweight version of a traditional plastic collapsible container. The frame 12 keeps the corrugate insert 14 in its proper shape to protect the produce. The frame 12 also provides the structure needed to be able to support the weight of the product stacks during shipping.

In accordance with the provisions of the patent statutes and jurisprudence, exemplary configurations described above are considered to represent preferred embodiments of the inventions. However, it should be noted that the inventions can be practiced otherwise than as specifically illustrated and described without departing from its spirit or scope. Alphanumeric identifiers on method steps are solely for ease in reference in dependent claims and such identifiers by themselves do not signify a required sequence of performance, unless otherwise explicitly specified.

What is claimed is:

1. A collapsible container comprising:

a frame including a base and a plurality of walls hingeably connected to edges of the base, wherein at least one wall of the plurality of walls has a large opening therethrough, wherein the large opening occupies a majority of the area of the at least one wall, a handle loop projecting into the large opening; and an insert received in the frame, wherein the insert at least substantially covers the large opening in the at least one wall, the insert including a handle opening aligned with the handle loop.

2. A collapsible container comprising:

a frame including a base and a plurality of walls hingeably connected to edges of the base, wherein at least one wall of the plurality of walls has a large opening therethrough, wherein the large opening occupies a majority of the area of the at least one wall, wherein the at least one wall includes a connector molded integrally therewith; and an insert received in the frame, wherein the insert at least substantially covers the large opening in the at least one wall, wherein the connector is received in an opening through the insert to retain the insert to the at least one wall.

3. The collapsible container of claim 2 wherein the base and plurality of walls of the frame are each molded plastic and wherein the insert is formed of a material different from the frame.

4. The collapsible container of claim 3 wherein the insert is formed of cardboard.

5. The collapsible container of claim 4 wherein the insert lines the base.

6. The collapsible container of claim 5 wherein the insert includes an insert base supported on the base of the frame, wherein the insert base includes a raised portion.

7. The collapsible container of claim 6 wherein the insert is folded to form the raised portion.

8. The collapsible container of claim 7 wherein the at least one wall includes an upper rail above the large opening and the upper rail includes an inner surface tapered outward as one progresses upward, such that a portion of the insert abutting the inner surface of the rail is angled outward at an upper end thereof.

9. The collapsible container of claim 7 wherein the at least one wall includes an upper rail above the large opening, a lower rail below the large opening and end rails connecting the upper rail to the lower rail on either side of the large opening, wherein a recess is formed in an interior-facing surface of the upper rail of the at least one wall for receiving a portion of the insert therein.

10. The collapsible container of claim 9 wherein the portion of the insert is received in the recess with a friction or interference fit.

11. The collapsible container of claim 10 wherein the at least one wall includes at least one connector connected to at least one connector of the insert.

12. The collapsible container of claim 6 wherein the insert is a single piece of cardboard including side panels extending upward from the insert base, wherein the raised portion of the insert base is between the side panels and spaced away from each of the side panels.

13. The collapsible container of claim 4 wherein the insert is a single piece of cardboard including an insert base supported on the base of the frame and side panels extending upward from the insert base, the side panels having handle openings therethrough.

14. The collapsible container of claim 2 wherein the insert includes a handle opening aligned with a handle opening in the frame.

15. The collapsible container of claim 2 wherein the at least one wall includes an upper rail above the large opening and a plurality of spaced-apart columns connecting the upper rail to a lower rail.

16. A collapsible container comprising:

a frame including a base and a plurality of walls hingeably connected to edges of the base, wherein at least one wall of the plurality of walls has a large opening therethrough, wherein the large opening occupies a majority of the area of the at least one wall, wherein the at least one wall includes an upper rail above the large opening, a lower rail below the large opening, and a pair of end rails connecting the upper rail to the lower rail on either side of the large opening, wherein the end rails have projecting portions shaped like bananas projecting into the large opening; and an insert received in the frame, wherein the insert at least substantially covers the large opening in the at least one wall.

17. A collapsible container comprising:

a frame including a base and a plurality of walls hingeably connected to edges of the base, wherein each of the plurality of walls has a large opening therethrough, wherein the large opening occupies a majority of the area the respective wall, wherein each of the plurality of walls includes an upper rail above the large opening, a lower rail below the large opening and end rails connecting the upper rail to the lower rail on either side of the large opening, wherein at least one of the plurality of walls includes a handle loop projecting into the large opening; and an insert received in the frame, the insert including a handle opening aligned with the handle loop, wherein the insert includes an insert base supported on the base of the frame and side panels, which side panels at least substantially cover the large opening in each of the plurality of walls, the insert base including a raised portion between the side panels and extending generally parallel to the side panels.

18. The collapsible container of claim 17 wherein the base and plurality of walls of the frame are each molded plastic and wherein the insert is formed of a material different from the frame.

19. The collapsible container of claim 18 wherein the insert is formed of cardboard.

20. The collapsible container of claim 18 wherein the insert is folded to form the raised portion.

* * * * *